US010553976B1

(12) United States Patent
Thein et al.

(10) Patent No.: US 10,553,976 B1
(45) Date of Patent: Feb. 4, 2020

(54) ELECTRICAL CONNECTION DEVICE

(71) Applicants: Robert Hla Thein, Fremont, CA (US); Ryan Ho Thein, Union City, CA (US)

(72) Inventors: Robert Hla Thein, Fremont, CA (US); Ryan Ho Thein, Union City, CA (US)

( * ) Notice: Subject to any disclaimer, the term of this patent is extended or adjusted under 35 U.S.C. 154(b) by 0 days.

(21) Appl. No.: 16/139,171

(22) Filed: Sep. 24, 2018

(51) Int. Cl.
*H01R 12/00* (2006.01)
*H01R 12/73* (2011.01)
*H01R 13/03* (2006.01)
*H01R 13/05* (2006.01)

(52) U.S. Cl.
CPC ..... *H01R 12/737* (2013.01); *H01R 13/035* (2013.01); *H01R 13/055* (2013.01)

(58) Field of Classification Search
CPC ... H01R 12/737; H01R 13/055; H01R 13/035
USPC ..... 439/62, 851
See application file for complete search history.

(56) References Cited

U.S. PATENT DOCUMENTS 4,781,612 A * 11/1988 Thrush ..... H01R 12/716 439/328
4,995,825 A * 2/1991 Korsunsky ..... H01R 12/7005 439/326
5,156,554 A * 10/1992 Rudoy ..... H01R 13/6471 439/108
5,496,182 A * 3/1996 Yasumura ..... H01R 12/62 439/62
5,505,626 A * 4/1996 Grabbe ..... H01R 12/71 439/62
5,582,519 A * 12/1996 Buchter ..... H01R 13/652 439/101
5,676,559 A * 10/1997 Laub ..... H01R 12/62 439/260
6,036,519 A * 3/2000 Lopata ..... H01R 12/716 439/260
6,296,519 B1 * 10/2001 Hashizawa ..... H01R 13/6599 439/607.42
6,347,950 B1 * 2/2002 Yokoyama ..... H01R 13/6315 439/248
6,402,525 B2 * 6/2002 Gugliotti ..... H01R 12/7088 439/62
6,488,549 B1 * 12/2002 Weller ..... H01R 13/6485 439/181
6,890,214 B2 * 5/2005 Brown ..... H01R 12/725 439/607.05
7,011,548 B2 * 3/2006 Bogiel ..... H01R 12/727 439/247
7,083,433 B2 * 8/2006 Misawa ..... H01R 12/7088 439/80
7,476,108 B2 * 1/2009 Swain ..... G06F 1/20 439/487
7,613,011 B2 * 11/2009 Grundy ..... H01R 12/7082 361/736

(Continued)

*Primary Examiner* — Abdullah A Riyami
*Assistant Examiner* — Nelson R. Burgos-Guntin
(74) *Attorney, Agent, or Firm* — Ted Masters

(57) ABSTRACT

An electrical connection device includes a female connector which has a slot. A male connector has an undulated projection which is insertable into the slot. The slot has a slot width, and the undulated projection has a projection width which is greater than the slot width. The electrical connection device is capable of carrying more current that existing solder and compliant tail connections. In a second embodiment an undulated sleeve is applied to a circular connector.

1 Claim, 9 Drawing Sheets

(56) References Cited

U.S. PATENT DOCUMENTS

| | | | | |
|---|---|---|---|---|
| 8,839,513 | B2 * | 9/2014 | Nakamura | G01D 1/00 29/876 |
| 9,711,897 | B2 * | 7/2017 | Ho | H01R 13/631 |
| 2002/0028588 | A1 * | 3/2002 | Watanabe | H01R 12/721 439/62 |
| 2004/0048496 | A1 * | 3/2004 | Chi | H01R 12/716 439/62 |
| 2007/0155194 | A1 * | 7/2007 | Vega Martinez | H05K 1/142 439/62 |
| 2011/0111606 | A1 * | 5/2011 | Lee | H01R 12/613 439/62 |

* cited by examiner

FIG. 4
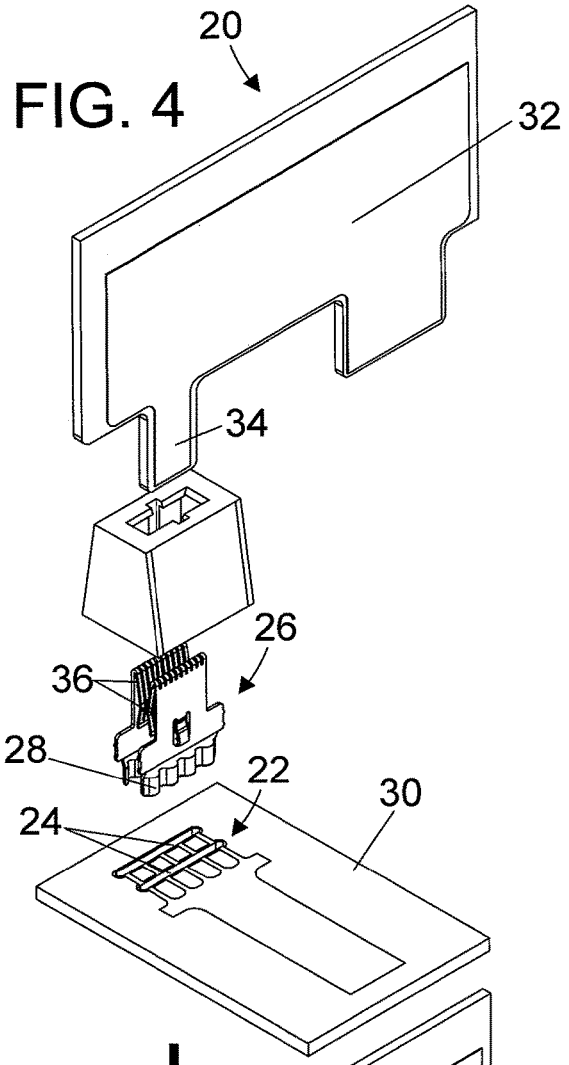
FIG. 6
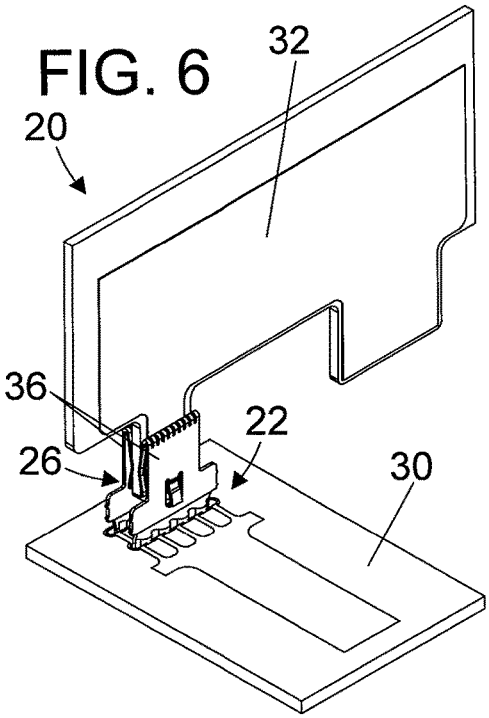
FIG. 7
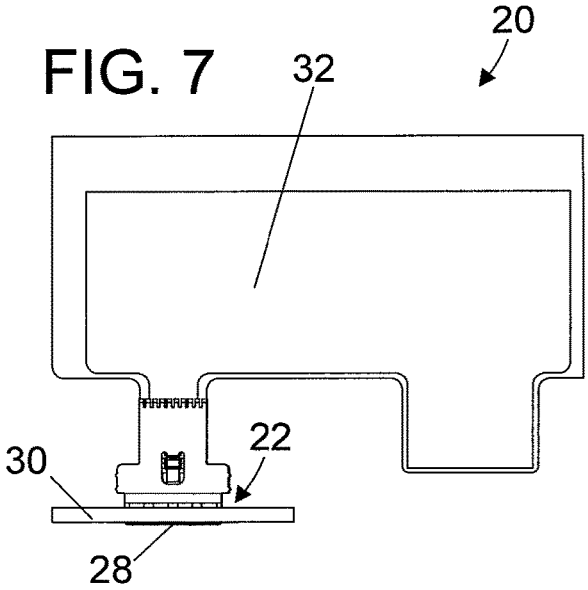
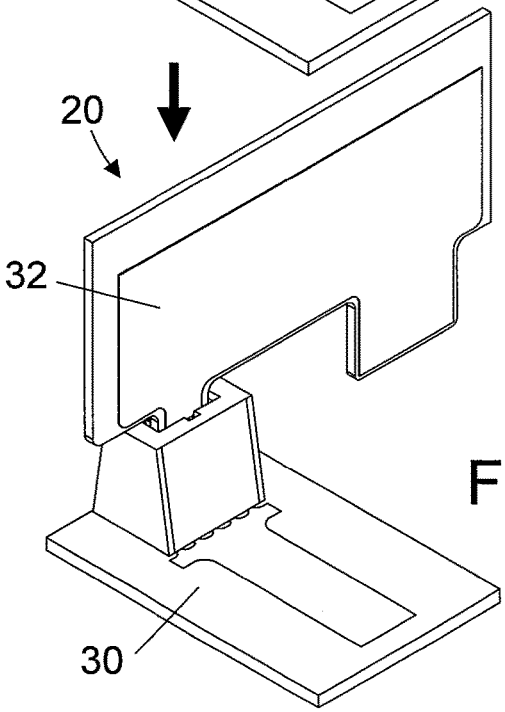
FIG. 5

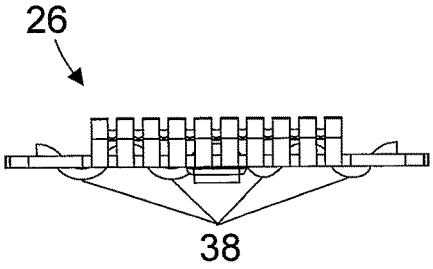
FIG. 8
FIG. 9
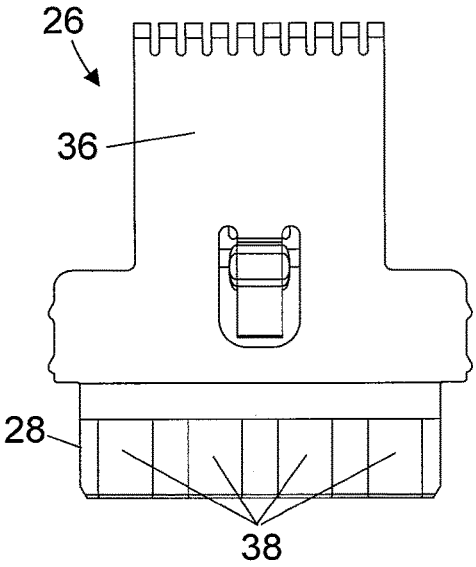
FIG. 10
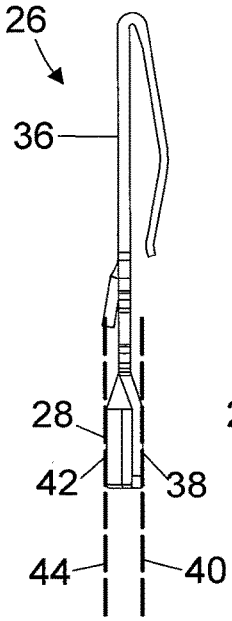
FIG. 11
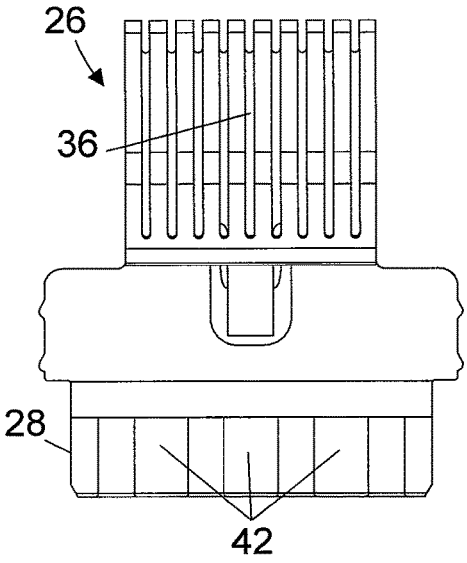
FIG. 12
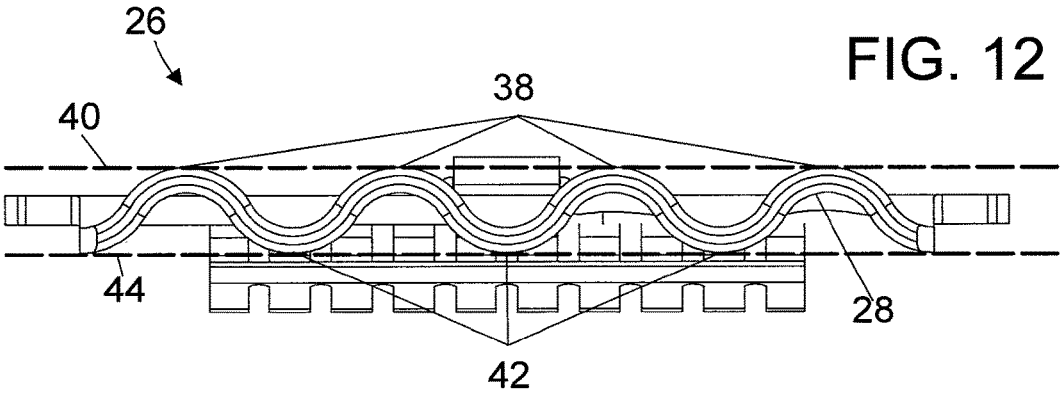

FIG. 13
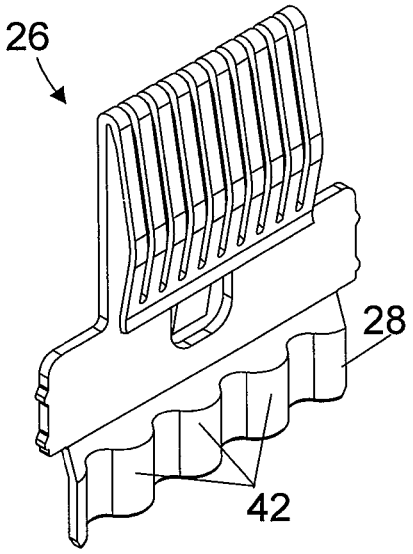
FIG. 14
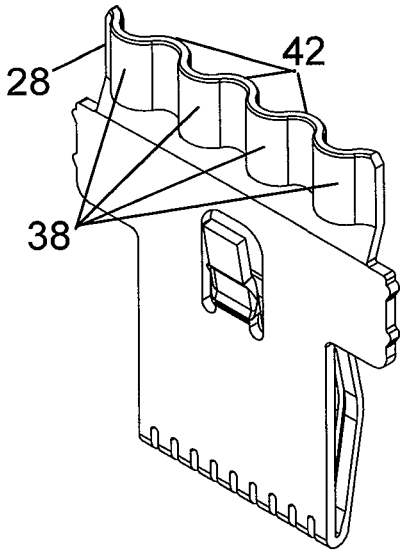
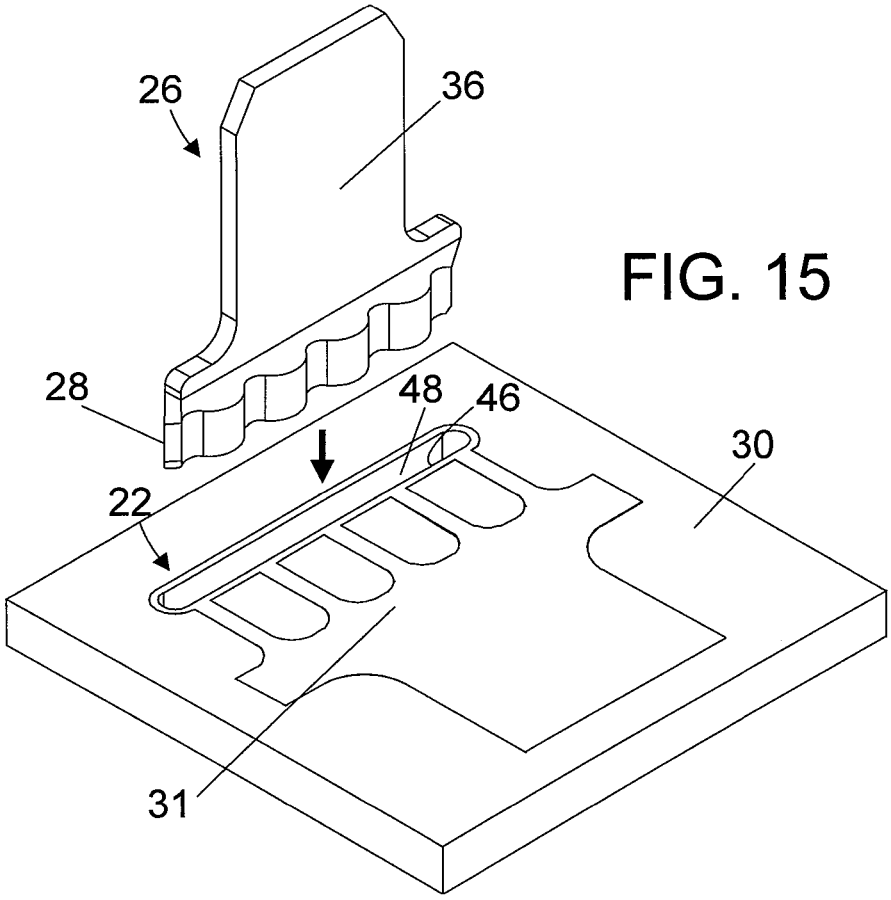
FIG. 15

FIG. 16
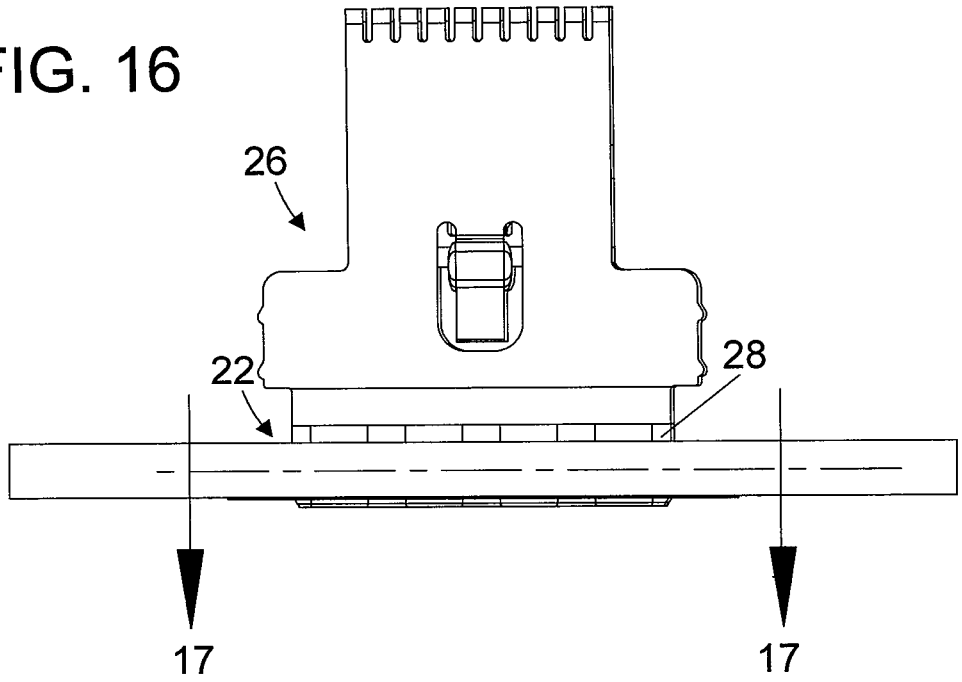
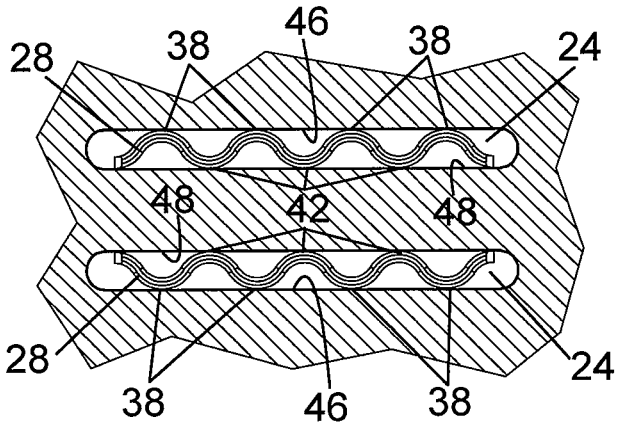
FIG. 17
FIG. 18
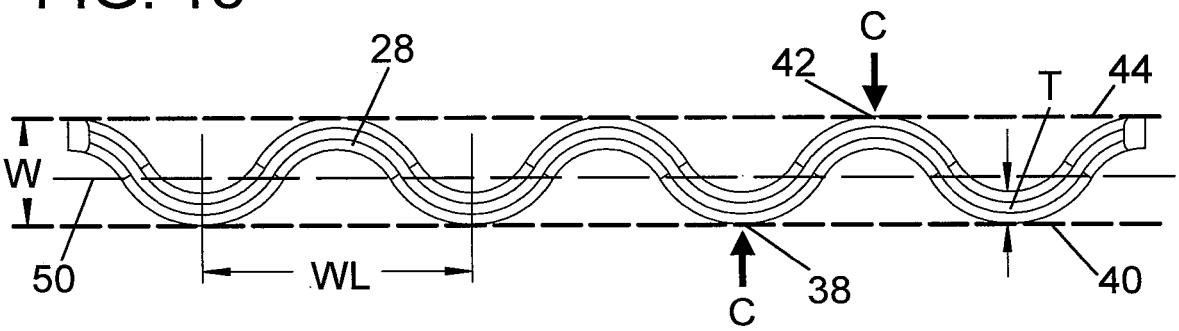

FIG. 23
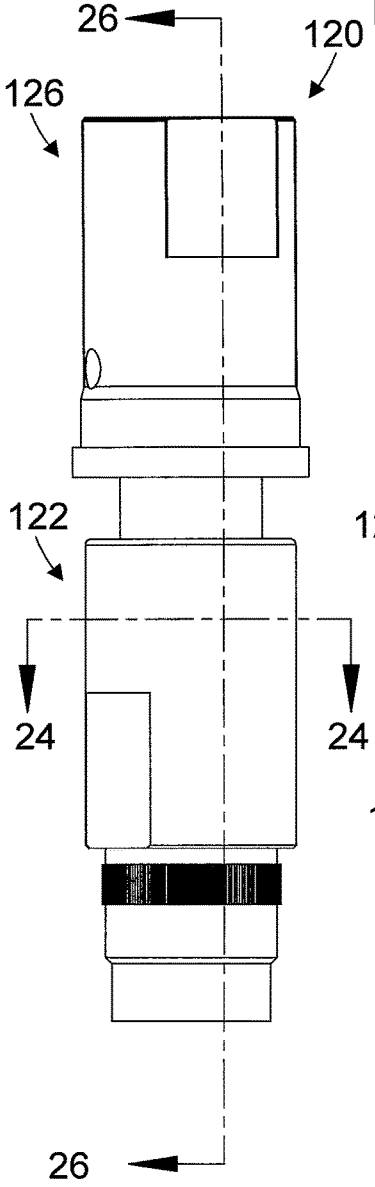
FIG. 26
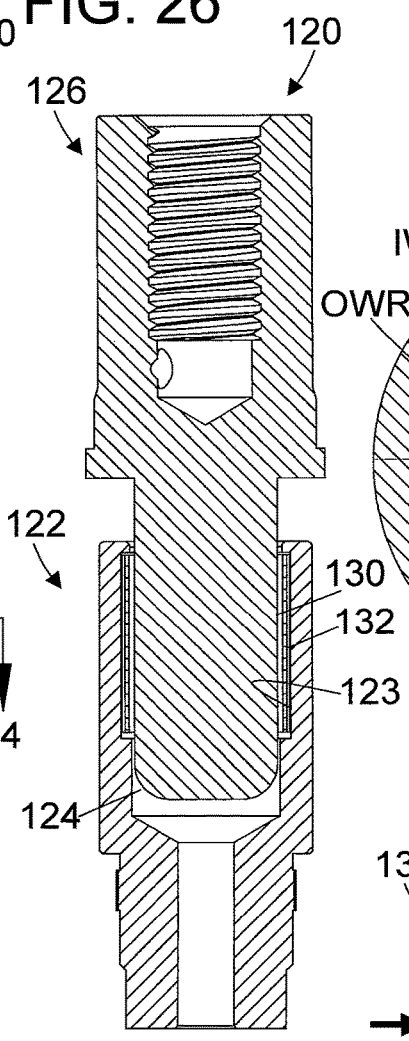
FIG. 24
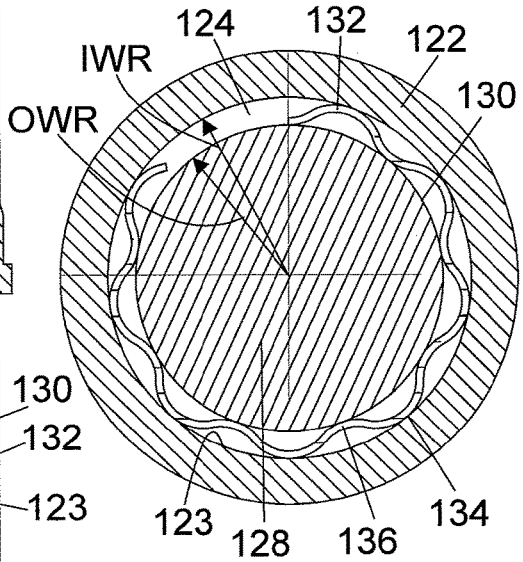
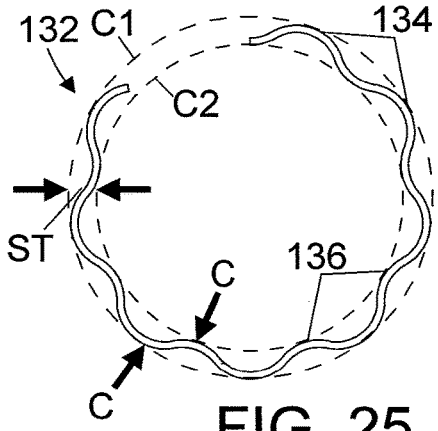
FIG. 25

ELECTRICAL CONNECTION DEVICE

CROSS REFERENCE TO RELATED APPLICATION

None

TECHNICAL FIELD

The present device pertains generally to the field of electronics, and more particularly to an electrical connector which includes an undulated projection which plugs into a slot. In another embodiment a circular connector includes an undulated sleeve.

BACKGROUND OF THE INVENTION

Various methods are known for making electrical contact between circuit elements. The goal is to have a reliable electrical connection between contacts or connectors to a printed circuit boards or power distribution bus bars and transfer large amount of current with no restriction. For example, some prior art devices utilize solderless electrical contacts within a mounting board. These devices rely on the principle of deforming the hole as the contact is inserted therein for generating the retention force. This prior art solderless contact cannot be removed and reinstalled in the mounting board due to the deformation of the hole during the initial installation. Such connections also have a tendency to become less efficient over a prolonged period of time due to loss of both mechanical holding power and electrical continuity. The loss of mechanical holding power is caused by the initial deformation of the mounting board which tends to continue long after the mounting of the contact, thus allowing the contact to loosened within the hole. The loss of electrical continuity is caused when ambient atmosphere circulates between the contact and the hole opening allowing the development of corrosion therebetween.

Compliant tails are an improved form of solderless electrical connection. They require tight tolerance holes on the board which increases its cost and reusability of the component. The advantage of using compliant tails is to easily integrate electrical components without permanently soldering to the board. However, compliant pins are sometimes unable to retain their shape to produce the retention force needed to maintain the electrical continuity.

Solder is another form of electrical connection. However, the issue with soldering components to the printed circuit board (PCB) is the high temperature requirement which can warp and damage the board. In addition, the process of soldering components does not take into consideration the possible future failures that can occur. Replacing damaged electrical components could cause an increase in cost for rework and introduce the risk of scraping entire boards.

Nearly every prior art design has small cross sectional pins to carry electricity between the contact and the board or bus bar. This restricts the amount of current which can pass through these pins. Even though the main mating contacts are able to accommodate a large amount of current, the narrow cross section of the pins do not provide enough copper mass to effectively pass current. As such, large power application become problematic.

BRIEF SUMMARY OF THE INVENTION

The present invention is directed to an electrical connection device which provides greater current carrying capacity, and which is both reliable and reusable. The device includes a male connector which has an undulated projection. That is a projection with multiple adjacent wave shapes which form multiple ridges on both sides of the projection. The undulated projection is inserted into a female connector on a PCB or a bus bar which has a slot (such as a plated through hole). The undulated projection is press fit into the slot thereby creating a retention force. The spring force generated by the flexing undulated shape of the projection forms secure electrical continuity between the undulated contact and the board. The undulated design provides full width contact of multiple surfaces and provides increased copper mass as compared to the prior compliant design. Utilizing the full mating surface between the undulated projection and the board plating establishes a reliable, high amperage electrical connector, and eliminates the current choke points which are found in other designs. The principles of the present device can also be applied to circular receptacles that rely on an intermediary metal contact to create an electrically continuous connection.

Some of the advantages of the present electrical connection device are:

- Larger copper mass to carry more electrical current compared to the pin and needle shape of prior art devices.
- Provides contact over the full thickness of the PCB resulting in higher current carrying capacity.
- Resilient spring forces created by the undulated projection ensure a solid mechanical connection which resists shock and vibration.
- The undulated projection is reusable in that it can be inserted and removed multiple times without deformation of the projection or the slot.
- The undulated projection does not damage the plated walls of the receiving slot.

In accordance with an embodiment, an electrical connection device includes a female connector which has a slot. A male connector has an undulated projection which is insertable into the slot.

In accordance with another embodiment, the slot has a slot width. The undulated projection has a projection width which is greater than the slot width.

In accordance with another embodiment, the projection width is between 0.002 inches and 0.004 inches wider than the slot width.

In accordance with another embodiment, the undulated projection has a transverse axis The undulated projection is resiliently compressible perpendicular to the transverse axis.

In accordance with another embodiment, the undulated projection has a first side which includes a plurality of first ridges which define a first plane. The undulated projection has a second side which includes a plurality of second ridges which define a second plane. The second plane is parallel to the first plane.

In accordance with another embodiment, the slot is formed by a first side wall and an opposite second side wall. The undulated projection is insertable into the slot so that the plurality of first ridges abut the first side wall of the slot, and the plurality of second ridges abut the second side wall of the slot.

In accordance with another embodiment, a number of first ridges and a number of second ridges determining a current carrying capacity of the electrical connection device.

In accordance with another embodiment, the slot is a plated through hole on a printed circuit board.

In accordance with another embodiment, the female connector includes a single slot, and the male connector includes a single undulated projection.

In accordance with another embodiment, the female connector is disposed on a primary circuit board. A secondary circuit board has a secondary circuit board connector. The male connector includes a secondary connector which is shaped and dimensioned to connect to the secondary circuit board connector of the secondary circuit board.

In accordance with another embodiment, the female connector includes two the slots, and the male connector includes two the undulated projections.

In accordance with another embodiment, an electrical connection device includes a female connector which has an inner wall which forms an aperture. A male connector has a plug which is insertable into the aperture, the plug has an outer wall. An undulated sleeve is positionable between the inner wall of the female connector and the outer wall of the plug.

In accordance with another embodiment, the inner wall of the female connector has an inner wall radius, and the outer wall of the plug has an outer wall radius. The undulated sleeve has a sleeve thickness which is greater than a difference between the inner wall radius of the female connector and the outer wall radius of the male connector.

In accordance with another embodiment, the sleeve thickness is between 0.002 inches and 0.004 inches greater than the difference between the inner wall radius of the female connector and the outer wall radius of the male connector.

In accordance with another embodiment, the undulated sleeve is resiliently radially compressible.

In accordance with another embodiment, the undulated sleeve has a first side which includes a plurality of first ridges which define a first cylindrical shape. The undulated sleeve has a second side which includes a plurality of second ridges which define a second cylindrical shape.

In accordance with another embodiment, the undulated sleeve is positionable between the inner wall of the female connector and the outer wall of the plug so that the plurality of first ridges abut the inner wall of the female connector, and the plurality of second ridges abut the outer wall of the plug.

Other embodiments, in addition to the embodiments enumerated above, will become apparent from the following detailed description, taken in conjunction with the accompanying drawings, which illustrate, by way of example, the principles of the electrical connection device.

BRIEF DESCRIPTION OF THE DRAWINGS

FIG. 4 is an exploded perspective view of an electrical connection device;

FIG. 5 is a perspective view of the electrical connection device of FIG. 4 in a connected position;

FIG. 6 is a view of FIG. 5 with a housing removed;

FIG. 7 is a front elevation view of the electrical connection device;

FIG. 8 is an enlarged top plan view of a male connector which has an undulated projection;

FIG. 9 is an enlarged front elevation view of the male connector;

FIG. 10 is an enlarged side elevation view of the male connector;

FIG. 11 is an enlarged rear elevation view of the male connector;

FIG. 12 is an again enlarged bottom plan view of the male connector;

FIG. 13 is an enlarged perspective view of the male connector;

FIG. 14 is an enlarged inverted perspective view of the male connector;

FIG. 15 is an enlarged perspective view of another male connector being inserted into a female connector;

FIG. 16 is an enlarged front elevation view of the male connector inserted into a female connector;

FIG. 17 is a fragmented cross sectional view along the line 17-17 of FIG. 16.

FIG. 18 is an enlarged bottom plan view of the undulated projection;

FIG. 23 is side elevation view of the second embodiment in the connected position;

FIG. 24 is an enlarged cross sectional view along the line 24-24 of FIG. 23; and, FIG. 25 is an enlarged end view of an undulated sleeve;

FIG. 26 is a cross sectional view along the line 26-26 of FIG. 23;

DETAILED DESCRIPTION OF THE INVENTION

Figure 1:
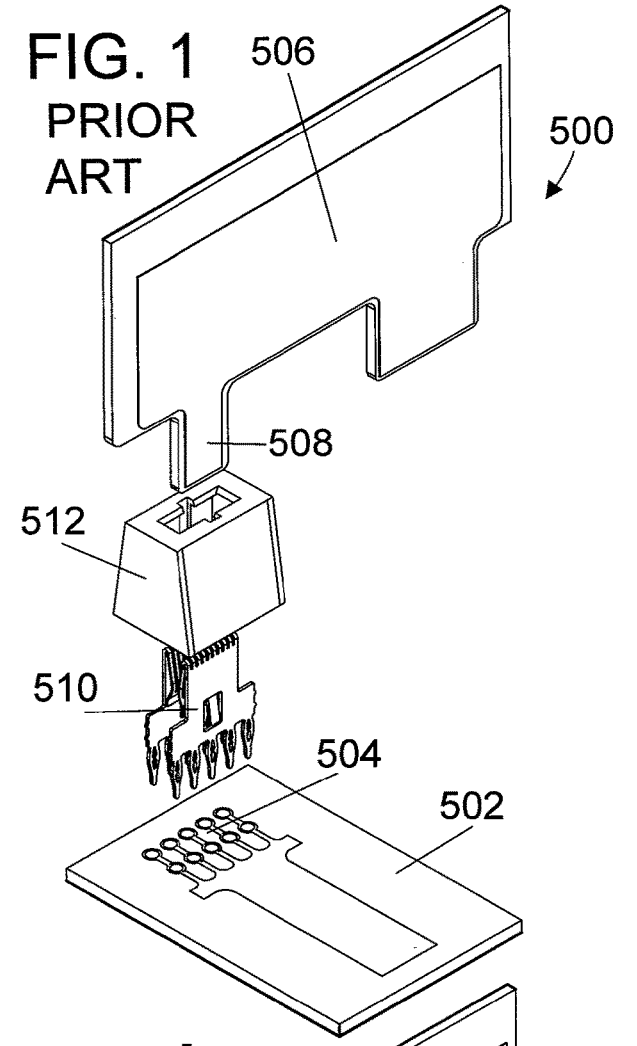
FIG. 1 PRIOR ART
FIG. 1 is an exploded perspective view of a prior art electrical connection device.
Figure 2:
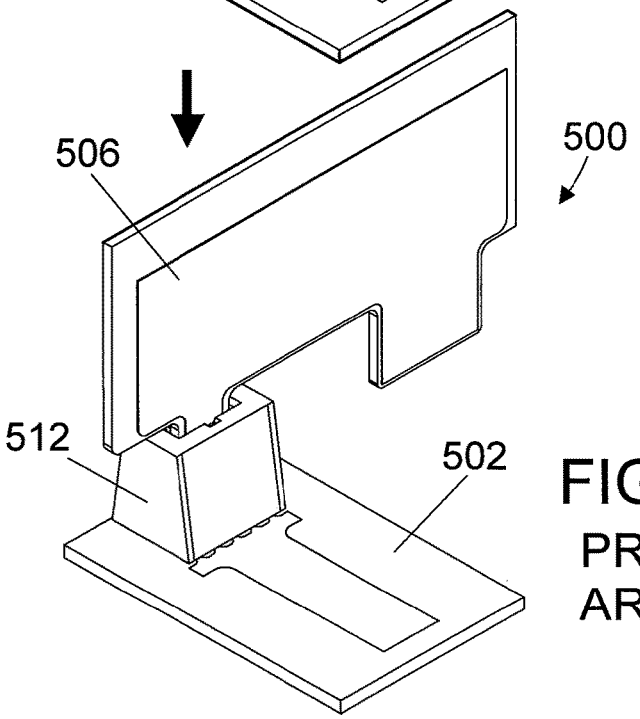
FIG. 2 PRIOR ART
FIG. 2 is a perspective view of the electrical connection device of FIG. 1 in a connected position.

Referring initially to FIG. 1, there is illustrated an exploded perspective view of a prior art electrical connection device, generally designated as 500. In this example a primary printed circuit board 502 (a.k.a. a motherboard) has a socket 504 with a plurality of holes. A secondary circuit board 506 (a.k.a. a daughter board) has a secondary circuit board connector 508, which in the example is a blade connector. Secondary circuit board connector 508 is received by a compliant tail connector 510 which plugs into (press fits into) socket 504 on primary printed circuit board 502. A housing 512 covers compliant tail connector 510. FIG. 2 shows electrical connection device 500 in a connected position. Such an electrical connection is typically used to provide power from primary circuit board 502 to secondary circuit board 506.

Figure 3:
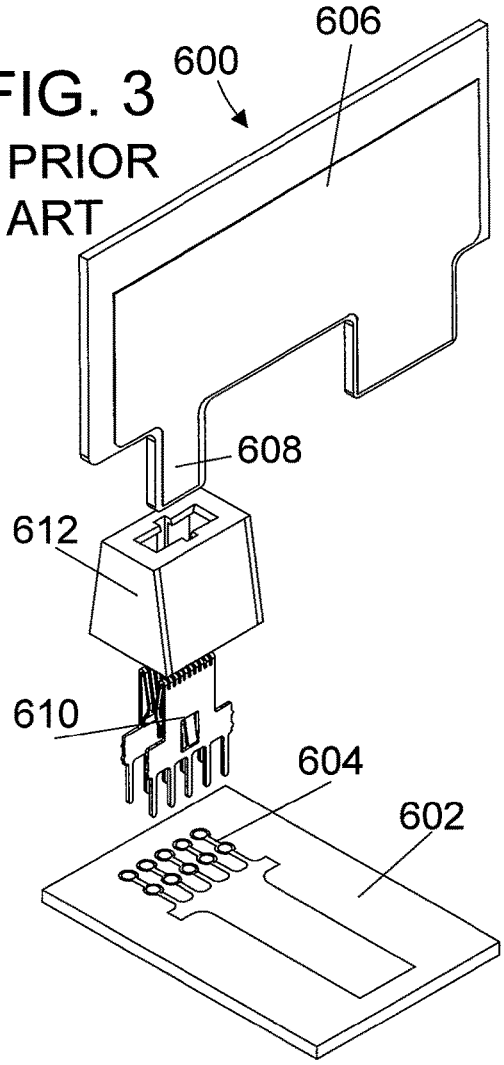
FIG. 3 PRIOR ART
FIG. 3 is an exploded perspective view of a second prior art electrical connection device.

FIG. 3 is an exploded perspective view of a second prior art electrical connection device, generally designated as 600. Similar to FIGS. 1 and 2, a primary printed circuit board 602 (a.k.a. a motherboard) has a socket 604 with a plurality of holes. A secondary circuit board 606 (a.k.a. a daughter board) has a secondary circuit board connector 608, which in the example is a blade connector. Secondary circuit board connector 608 is received by a solder tail connector 610 which is soldered to socket 604 on primary printed circuit board 602. A housing 612 covers solder tail connector 610.

FIG. 4 is an exploded perspective view of an electrical connection device, generally designated as 20. FIG. 5 is a perspective view of electrical connection device 20 in a connected position. FIG. 6 is a view of FIG. 5 with a housing removed, and FIG. 7 is a front elevation view of the electrical connection device 20. Electrical connection device 20 includes a female connector 22 which has a slot 24 (two slots in the shown embodiment) (also refer to FIGS. 17 and 19). Electrical connection device 20 further includes a male connector 26 (two in the shown embodiment) which has an undulated projection 28 which is insertable into slot 24 (refer also to FIGS. 8-14, and 16-18). In the shown embodiment, female connector 22 is disposed on a primary circuit board 30. A secondary circuit board 32 has a secondary circuit board connector 34. Male connector 26 includes a secondary connector 36 (two in the shown embodiment) which is shaped and dimensioned to connect to (receive) secondary circuit board connector 34 of secondary circuit board 32. In the shown embodiment secondary connector is a card edge connector. It is noted that in the shown embodiment female connector 22 includes two slots 24, and male connector 26 includes two undulated projections 28. Such a double connection increases current carrying capacity.

It is noted that undulated projection 28 of male connector 26 is removably insertable into slot 24 of female connector 22. As is shown in FIG. 7, undulated projection 28 is inserted all the way through slot 24. As will be discussed later, slot 24 of female connector 22 has two parallel walls which are abutted by undulated projection 28 of male connector 26. This abutment provides the electrical connection.

FIG. 8-14 are various views of male connector 26 with undulated projection 28. Undulated projection 28 has a first side which includes a plurality of first ridges 38. First ridges 38 define a first plane 40 (shown on edge by bold dashed lines in FIGS. 10 and 12). Undulated projection 28 has a second side which includes a plurality of second ridges 42. Second ridges 42 define a second plane 44 (shown on edge by bold dashed lines in FIGS. 10 and 12). Second plane 44 is parallel to first plane 40 (refer also to FIG. 18). In other words, undulated projection 28 comprises a wave-shaped member which has linearly extending ridges (crests) on both sides. The ridges are oriented in the direction of insertion. The ridges on each side are coplaner so that they can closely abut the walls which form slot 24 (refer also to FIG. 17). In an embodiment, a number of first ridges 38 and a number of second ridges 42 determine a current carrying capacity of the electrical connection device 20. That is, as the number of ridges increases, there is more contact with the walls which form slot 24, and therefore more current may be accommodated. In the shown embodiment each side of undulated projection 28 has four ridges, wherein the ridges on the second side include two end half ridges. It is noted that undulated projection 28 is similar to a blade connector, which instead of having a flat surface, has an undulated surface (similar to that of a washboard). In FIG. 14 it is also noted that the end of undulated projection 28 is chamfered to facilitate insertion into slot 24.

FIG. 15 is an enlarged perspective view of another male connector 26 being inserted into a female connector 24. Male connector 26 includes undulated projection 28 as previously described, however in this instance secondary connector 36 is a blade connector. It may be appreciated that secondary connector 36 can be any type of electrical connector which permits connection to another circuit. It is also noted that in this embodiment female connector 22 includes a single slot 24 and male connector 26 includes a single undulated projection 28 as opposed to the two projections of FIGS. 4-7. It may be appreciated that any number of undulated projections 28 may be utilized in order to meet current capacity needs. FIG. 15 also shows the printed circuitry 31 which makes connection with the walls which form slot 24 (also refer to FIGS. 17 and 19 and the associated discussions).

FIG. 16 is an enlarged front elevation view of the male connector 26 inserted into female connector 22, and FIG. 17 is a fragmented cross sectional view along the line 17-17 of FIG. 16. Slot 24 is formed by a first side wall 46 and an opposite second side wall 48. Undulated projection 28 is insertable into slot 24 so that the plurality of first ridges 38 abut first side wall 46 of slot 24, and the plurality of second ridges 42 abut second side wall 48 of slot 24 (also refer to FIGS. 15, 17, and 19).

Also referring to FIG. 18, undulated projection 28 has a transverse axis 50. Undulated projection 28 is resiliently compressible perpendicular to transverse axis 50 (in the directions C of FIG. 18). That is, undulated projection 28 has a spring-like property wherein first ridges 38 and second ridges 42 can be moved toward one another (i.e. compressed), such as by insertion into a slightly narrower slot 24 (refer to discussion below). As such, the resilience of undulated projection 28 forces first ridges 38 and second ridges 42 against the walls 46 and 48 which form slot 24. This resilient force tends to hold undulated projection 28 in place within slot 24 even in the presence of shock and vibration. When undulated projection 28 is removed from slot 24 it will return to its uncompressed state. Put another way, undulated projection 28 is press fit into slot 24 wherein the compression of undulated projection 28 facilitates the press fit.

Using beryllium copper material also known as spring copper for the construction of undulated projection 28 gives an exceptional spring effect. When undulated projection 28 is inserted into the PCB board or bus bar the spring force from the undulated design will be applied against the walls 46 and 48 evenly and consistently to give a secure connection. The number of undulations and material thickness can be adjusted to accommodate stronger forces as required.

FIG. 18 is an enlarged bottom plan view of undulated projection 28. First ridges 38 define first plane 40, and second ridges 42 define second plane 44. In an embodiment, undulating projection 28 has a thickness T of about 0.012 inches, a length between ridges (wave length) WL of about 0.100 inches, and a width W of about 0.040 inches. It is noted however that the specific dimensions of undulated projection 28 can be changed to accommodate electrical needs. Generally speaking increased thickness T and decreased wave length WL will result in a larger current carrying capacity.

Figure 19:
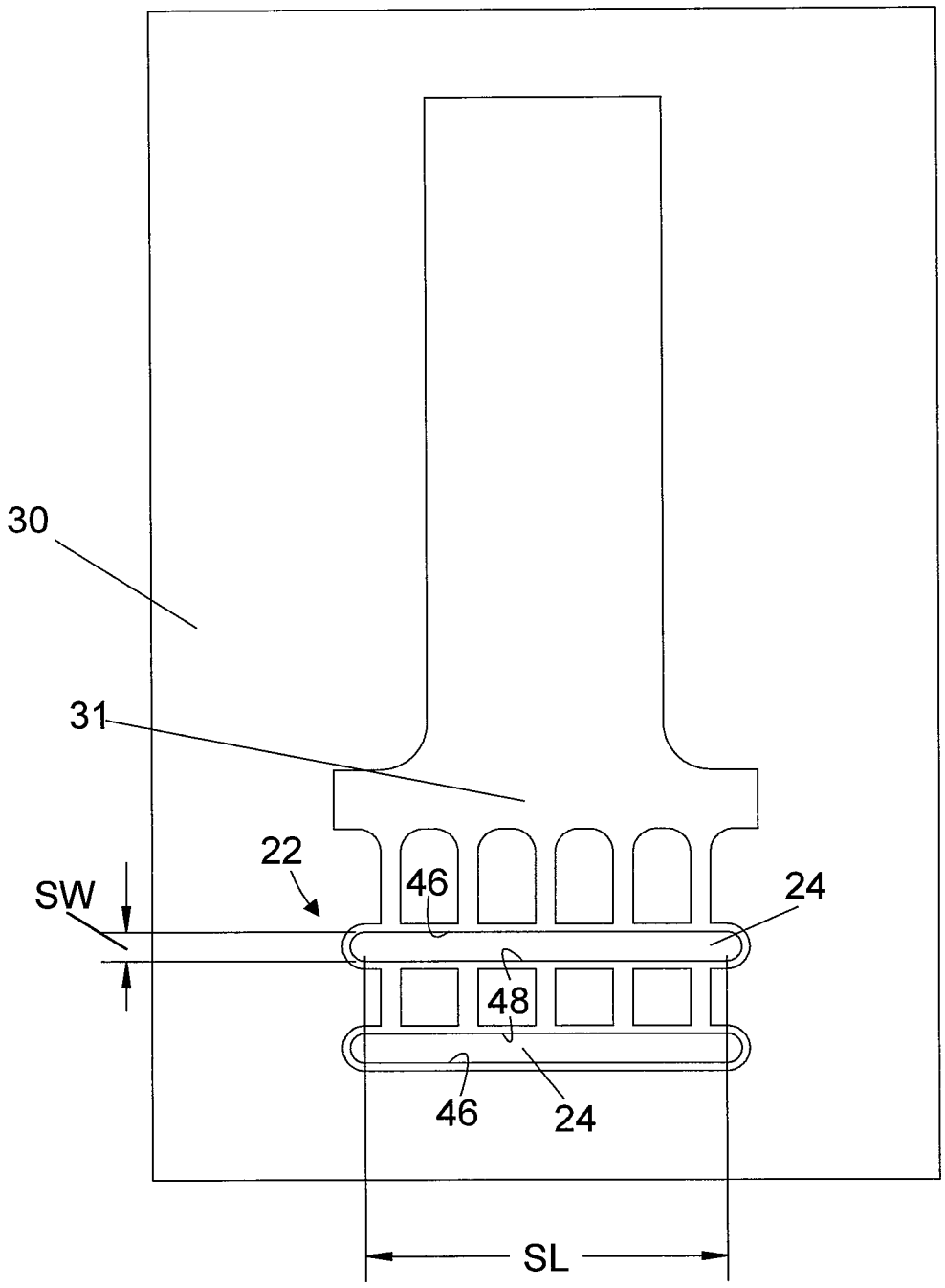
FIG. 19 is an enlarged top plan view of a female connector having a slot.
Figure 20:
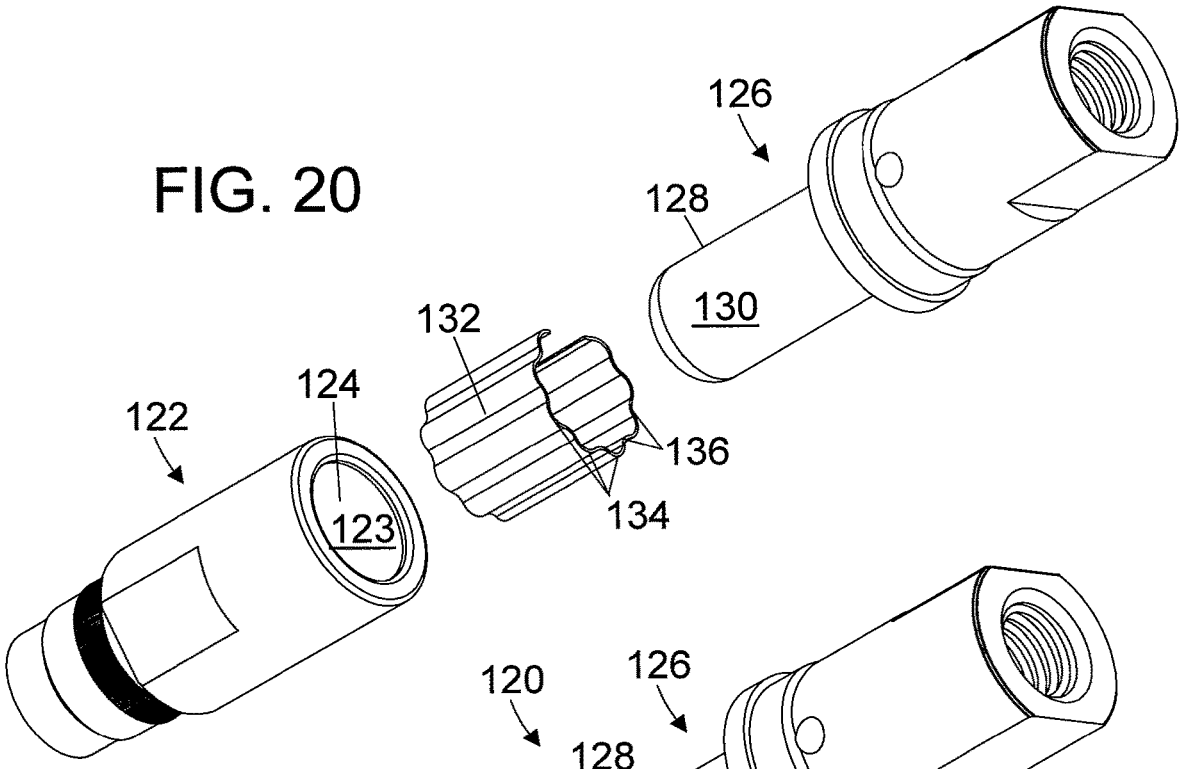
FIG. 20 is an exploded perspective view of a second embodiment of the electrical connection device.
Figure 21:
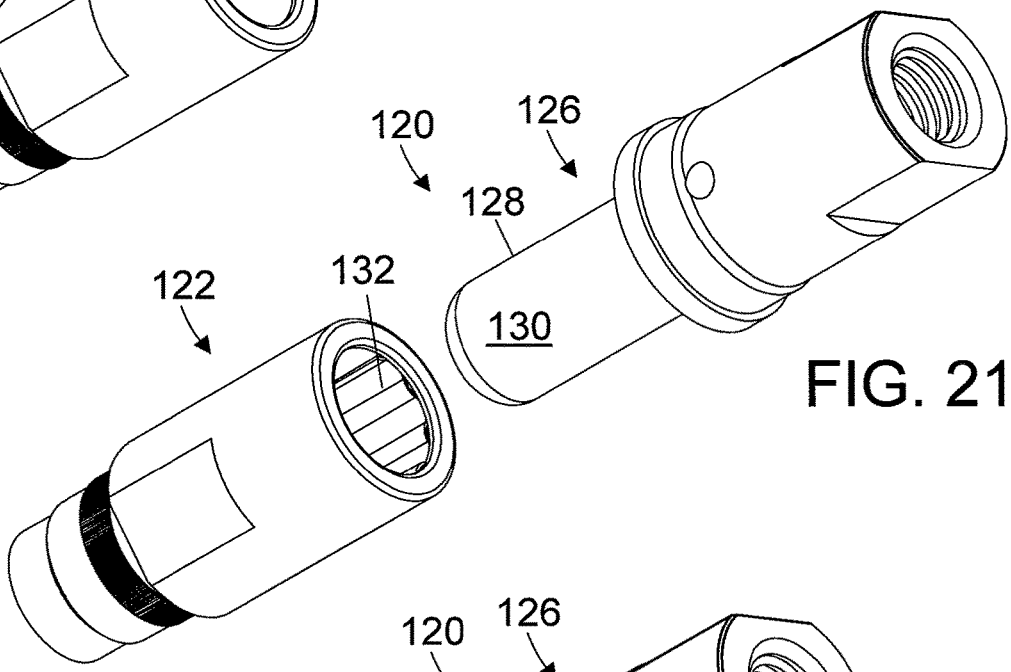
FIG. 21 is a perspective view of the second embodiment.
Figure 22:
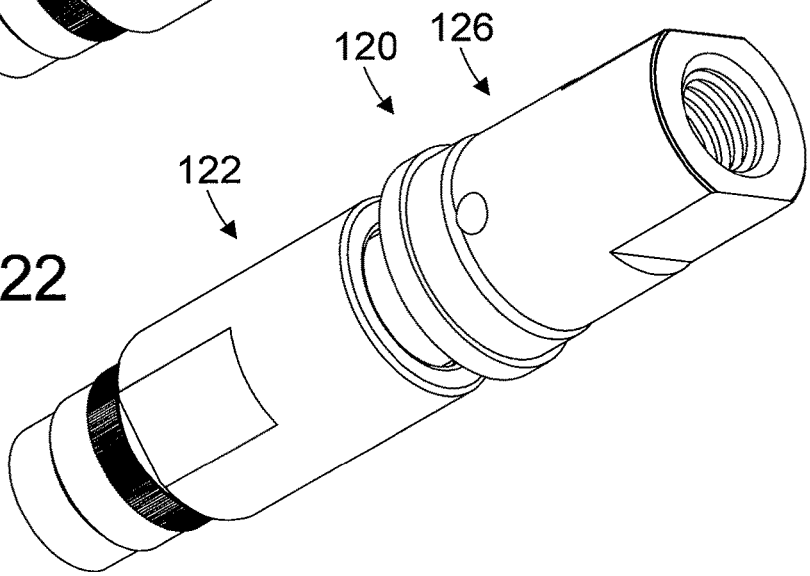
FIG. 22 is a perspective view of the second embodiment in a connected position.

FIG. 19 is an enlarged top plan view of female connector 22 with slot 24 (two slots as shown). In the shown embodiment, slot 24 is a plated through hole on printed circuit board 30. Slot 24 has a slot width SW. Referring also to FIG. 18, undulated projection 28 has a projection width W which is slightly greater than slot width SW. As such, when undulated projection 28 is inserted into slot 24 it will resiliently compress slightly, thereby ensuring a tight fit so that current can pass through the walls 46 and 48 which form slot 24 to undulated projection 28. In an embodiment projection width W is between 0.002 inches and 0.004 inches wider than slot width SW. In an embodiment walls 46 and 48 which form slot 24 are made from copper.

Referring now to FIGS. 20-23, there are illustrated perspective and side elevation views of a second embodiment of the electrical connection device, generally designated as 120. FIGS. 24 and 26 are cross sectional views, and FIG. 25 is an end view of an undulated sleeve. Electrical connection device 120 includes a female connector 122 which has an inner wall 123 which forms an aperture 124. A male connector 126 has a plug 128 which is insertable into aperture 124. Plug 128 has an outer wall 130. An undulated sleeve 132 is positionable between inner wall 124 of female connector 122 and outer wall 130 of plug 128. In the shown embodiment aperture 124 and plug 128 are circular. It is also noted that in the shown embodiment undulated sleeve 132 is first positioned into aperture 124 and then plug 128 is inserted into undulated sleeve 132.

Also referring to FIG. 25, undulated sleeve 132 has a first side which includes a plurality of first ridges 134 which define a first cylindrical shape C1 (shown on end). Undulated sleeve 132 has a second side which includes a plurality of second ridges 136 which define a second cylindrical shape C2. It is noted that undulated sleeve 132 is similar to previously describe undulated projection 28. That is, undulated sleeve 132 comprises a wave-shaped member which has linear ridges (crests) on both sides. The ridges are oriented in the direction of insertion. However in undulated sleeve 132 the ridges are disposed in a generally circular configuration rather than being coplanar. As such the crests of the ridges form the cylindrical shapes C1 and C2.

Also referring to FIG. 24, undulated sleeve 132 is positionable between inner wall 123 of female connector 122 and outer wall 130 of plug 126 so that the plurality of first ridges 134 abut inner wall 123 of female connector 122, and the plurality of second ridges 136 abut the outer wall 130 of plug 126. Inner wall 123 of female connector 122 has an inner wall radius IWR. Outer wall 130 of plug 128 has an outer wall radius OWR. Undulated sleeve 132 has a sleeve thickness ST (refer to FIG. 25) which is slightly greater than a difference between inner wall radius IWR of female connector 122 and outer wall radius OWR of male connector 126. That is, ST>IWR−OWR. In an embodiment, sleeve thickness ST is between 0.002 inches and 0.004 inches greater than the difference between inner wall radius OWR of female connector 122 and outer wall radius OWR of male connector 126. It is further noted that undulated sleeve 132 is resiliently radially compressible. That is, undulated sleeve 132 is resiliently radially compressible in the directions C of FIG. 25). That is, undulated sleeve 132 has a spring-like property wherein first ridges 134 and second ridges 136 can be moved radially toward one another (i.e. compressed). As such, when plug 128 is inserted into aperture 124 which contains undulated sleeve 132, undulated sleeve 132 compresses and holds plug 128 in place in aperture 124. Put another way, plug 128 is press fit into undulated sleeve 132.

Figure 27:
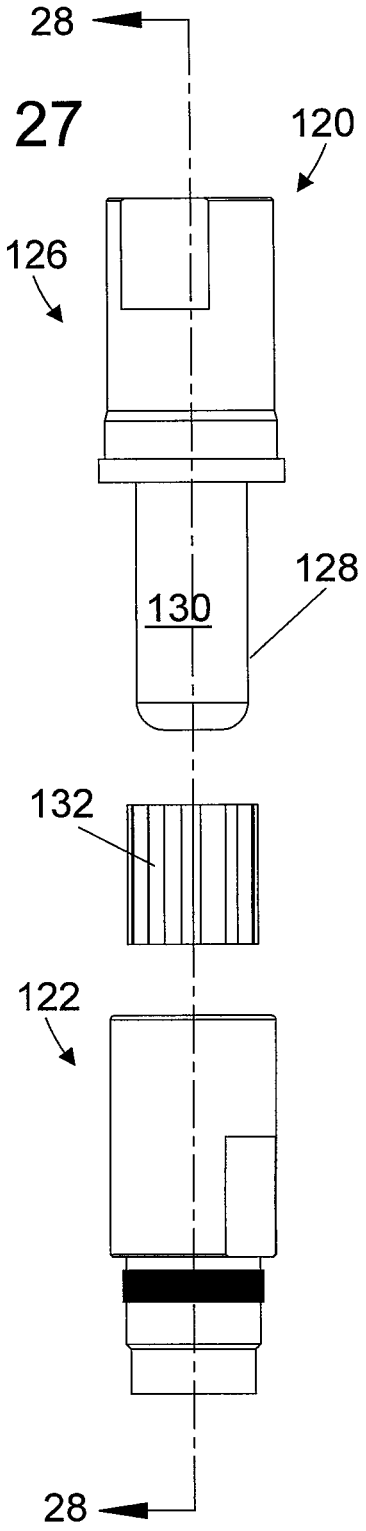
FIG. 27 is an exploded side elevation view of the second embodiment.
Figure 28:
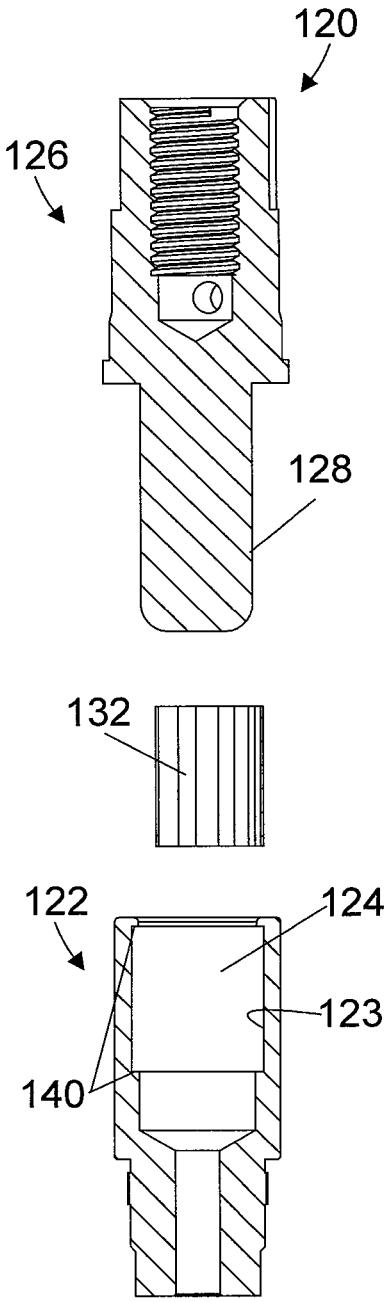
FIG. 28 is a cross sectional view along the line 28-28 of FIG. 27

FIG. 27 is an exploded side elevation view of the second embodiment, and FIG. 28 is a cross sectional view along the line 28-28 of FIG. 27. Shown are electrical connection device 120, female connector 122, inner wall 123, aperture 124, male connector 126, plug 128, and plug wall 130. In FIG. 28 it is noted that female connector 122 includes ledges 140 which hold undulated sleeve 12 in place inside aperture 124.

Additional Aspects of the Electrical Connection Device:

Referring to FIGS. 1-19 the disclosed electrical connection device 20 provides an increase in current flow due to multiple contact surfaces transferred through an increase in copper mass and surface area. Prior art devices are limited due to their restricted access caused by a small cross sectional surface area of their pins and compliant tail design. Conversely the present device provides a reliable solderless electrical connection which is capable of handling a larger amount of current flowing through an increased copper mass. The majority of compliant tails contain a limiting factor in regards to current flow. Compliant tail pins which are inserted into the plated aperture of the PCB contain a small cross-sectional area, and therefore only allow a small amount of current to flow through. The transition from the electrical contact interface to the main body of the contact creates a choke point for the current flow resulting in multiple compliant tails needed to power the desired component. In addition, pin contacts will typically contain two points of contact for electrical continuity. On the other hand, the design of the present electrical connection device 20 is such that the peaks of the undulated section allows for multiple contact interfaces, resulting in higher current flow With the increased copper mass. The transition between the point of electrical contact to the main body is nearly a constant cross sectional area, thus allowing current to flow unrestricted.

The contact points for a compliant tail to the board are the two highest points on its sides, whereas in the present device 20 the contact is the full thickness of the board (refer to FIGS. 7 and 16). The prior art solderless electrical contact utilizes the rounded feature of the press-fit compliant tail pin to maintain the electrical continuity. However, due to the tangential contact with the plating surface, the curvature of the pin creates a point contact and is unable to utilize the full surface area available. Conversely, the undulated projection 28 area of contact extends through the full thickness of the PCB achieving a full length of the contact. The multiple contact interfaces of the plurality of ridges 38 and 42 paired with full contact for the width of the PCB allows for higher current flow with less resistance.

The resilient property of undulated projection 28 causes it to conform to plated through slot 24 due to the spring action of the elastically deformed shape during insertion, and creates a gas tight joint and will spring back to its original shape when pull out of slot 24. Prior devices of the soldered tail type use a reflow soldering process to permanently fix electrical contacts to the PCB. Soldered connections only rely on the adhesive strength of the solder joint and electrical PCB components become irreparable once failure occurs. Press-fit solutions such as eye of needle pins do not require a subsequent soldering process and rely on retention forces to maintain electrical contact with the PCB plating. However, even under ideal conditions this design has a finite reusable allowance before the compliant pin is plastically deformed and can no longer return to its original shape to maintain the retention forces. In the present device the undulated projection 28 is fabricated from resilient metal with elastic characteristics. Due to the wave (e.g. sinusoidal) shape of undulated projection 28, it can be easily inserted as the material conforms to the plated slot 24. The amplitude of the wave (i.e. the width of undulated projection 28) compresses and creates a retention force that prevents oxidation occurring between the interface of the contact and plated surface during operation.

Insertion of undulated projection 28 does not physically deform its shape or the PCB slot holes and its plating. Older designs of the compliant contacts used square pins to create the solderless interconnection between connector to PCB. This method proved to cause failure over time due to the weak mating interface. Square pins inserted into PCB through holes by way of plastically deforming the plating with the four edges of the pin, ultimately damage the plating. This method relies on the brute force applied to the through hole to maintain electrical continuity. Conversely, undulated projection 28 conforms to the PCB through hole preventing any physical damage.

Slot 24 occupies the same amount of space as the compliant pin holes of older designs. Currently, PCB's that require mounting of electrical components utilize circular through holes to interconnect solderless compliant tails. There would be minor modifications needed to shift from these pin contacts to the undulated contact of the present device. During the manufacturing process of the boards, instead of drilling consecutive through holes, milling a through slotted hole would be performed instead. No additional surface area of the board is needed to transition from circular through holes for pin contacts to slotted through holes for the undulated contact.

The present undulated projection 28 design can be adapted to most of the existing power electrical contacts and connectors which currently have pins or compliant tail design. The method for electrical connectivity such as square pins and eye of needle designs can be applied to different types of compliant contacts and the undulated contact would be no different. The undulated contact can be interchangeable amongst different electrical contacts and could seamlessly adapt to create solderless compliant tails.

The undulated projection 28 retains its shape to allow multiple insertions to increase lifecycle and reusability. Unlike the permanently soldered electrical pins, undulated projection 28 will be able to conform to its aperture (slot 24) without plastically deforming the metal contact interface. These characteristics of the undulated design greatly lengthen the lifecycle of the connector and the board. This ability of undulated projection 28 to conform to its designated aperture allows the electrical component to be inserted and disconnected multiple times, thus improving reusability.

The undulated projection 28 maintains continuous and uniform forces against the PCB slot walls to prevent loosening from shock and vibration. Compliant tails and circular receptacles contain one translational degree of freedom which can cause loosening of the contact in the event of shock or vibration. Such a failure can create an electrical disconnect and cause system failure. Whereas the multiple surfaces and the compression forces acting upon the undulated projection 28 allow the contact to be in constant connection with the board. The electrical connector or board experiences vibration, the chances of the electrical discontinuity reduces significantly due to multiple surface contacts.

In another embodiment of the present electrical connection device, designated as 120 (refer to FIGS. 20-28), electrical contact is between a circular plug 128 and a receptacle having a aperture 124 creating a small and reliable high amperage connection. A circular undulated sleeve 132 is positioned inside the receptacle and is secured to the receptacle. When the plug is inserted into the receptacle the full length of the undulated ridges will make the connection between the plug and receptacle. Because of the undulated configuration of the sleeve, the radial forces will evenly distribute between the receptacle walls and the plug and transfer a substantial amount of electric current with no restriction. Because of this design feature the functional dependability and to be able to withstand the shock and vibration is excellent. Similarly, the circular receptacle connector allows the undulated contact held within the female receptacle to flex in a radial arc direction according to the male receptacle.

The embodiments of the electrical connection device described herein are exemplary and numerous modifications, combinations, variations, and rearrangements can be readily envisioned to achieve an equivalent result, all of which are intended to be embraced within the scope of the appended claims. Further, nothing in the above-provided discussions of the electrical connection device should be construed as limiting the invention to a particular embodiment or combination of embodiments. The scope of the invention is defined by the appended claims.

We claim:

1. An electrical connection device, comprising:

a female connector having a slot;

a male connector having an undulated projection which is insertable into said slot;

said slot having a slot width;

said undulated projection having a projection width which is greater than said slot width;

said undulated projection having a transverse axis;

said undulated projection being resiliently compressible perpendicular to said transverse axis;

said undulated projection having a first side which includes a plurality of first ridges which define a first plane;

said undulated projection having a second side which includes a plurality of second ridges which define a second plane, said second plane being parallel to said first plane;

said slot formed by a first side wall and an opposite second side wall; and, said undulated projection insertable into said slot so that said plurality of first ridges abut said first side wall of said slot, and said plurality of second ridges abut said second side wall of said slot.

* * * * *